United States Patent [19]

Dennis

[11] Patent Number: 4,754,903

[45] Date of Patent: Jul. 5, 1988

[54] SOFTDRINK CARRIER

[76] Inventor: William M. Dennis, 9421 Steel, Detroit, Mich. 48228

[21] Appl. No.: 902,581

[22] Filed: Sep. 2, 1986

[51] Int. Cl.[4] ..... A45F 4/00

[52] U.S. Cl. ..... 224/148; 224/257; 224/205; 248/102

[58] Field of Search ..... 224/257, 906, 148, 202, 224/151, 205; 229/1.5 H; 248/102, 104

[56] References Cited

U.S. PATENT DOCUMENTS 2,704,625 3/1955 Huse ..... 224/906 X

*Primary Examiner*—Henry J. Recla
*Assistant Examiner*—David Voorhees
*Attorney, Agent, or Firm*—Cullen, Sloman, Cantor, Grauer, Scott, & Rutherford

[57] ABSTRACT

A softdrink carrier adapted to be worn around the neck of a user comprises an elongated strip having a central longitudinal slot defining a pair of separable shoulder straps forming a V-shaped opening to receive the user's head. A pouch forming member at one end of the strip is reverse folded over and in registry with the strip. The sides of the pouch forming member and strip are interconnected to define therebetween an upwardly opening pouch adapted to receive a cup of liquid.

7 Claims, 2 Drawing Sheets

FIG. 1
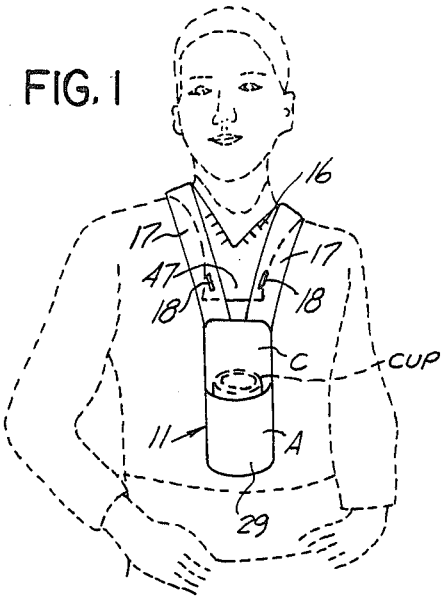
FIG. 2
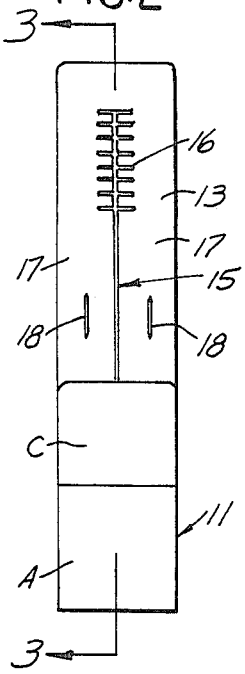
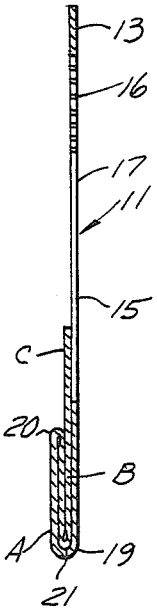
FIG. 3
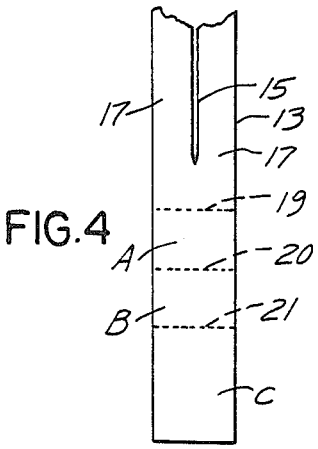
FIG. 4
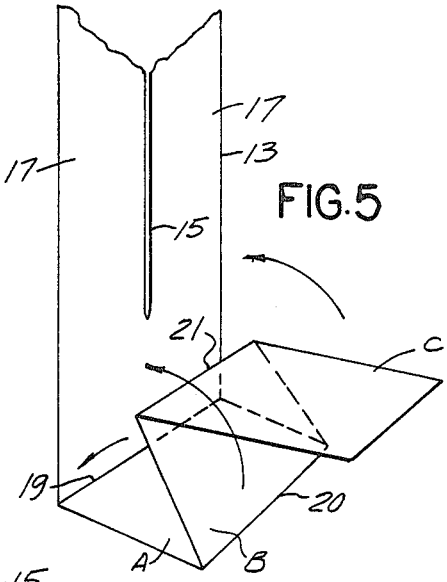
FIG. 5
FIG. 6
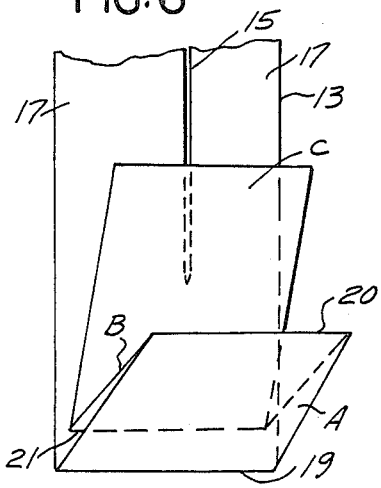
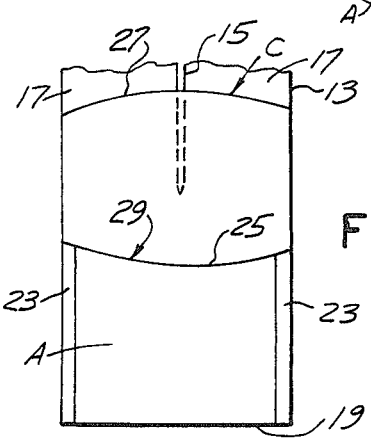
FIG. 7

SOFTDRINK CARRIER

FIELD OF INVENTION

The present softdrink carrier is formed of a strip of material having a longitudinal slit defining a pair of separable shoulder straps forming a V-shaped opening to received the users head with the lower end of the strip terminating in an upwardly opening pouch adapted to receive and support a cup of liquid.

BACKGROUND OF THE INVENTION

In the popular usage of people in theatres holding a softdrink during a performance or passengers of a vehicle holding a softdrink in a paper cup or the like there has been the difficulty of accidentally dropping or spilling the softdrink or tipping the container or cup.

Heretofore, in the use of a softdrink container or a container for hot beverages such as coffee, any tipping of the container can accidentally burn the user or damage clothes.

SUMMARY OF THE INVENTION

An important feature of the present invention is to provide a softdrink carrier further usable for carrying hot drinks, such as coffee, adapted to be worn around and depend from the neck and shoulders of a user which terminates in an upwardly opening pouch to enclose and supportably receive a cup containing a softdrink or coffee or other liquid to protect the same against accidental spilling.

Another feature is to provide a softdrink or beverage carrier made from an elongated strip of paper or plastic material which is disposable after a single usage.

Another feature of the softdrink carrier is an elongated strip having a central longitudinal slot intermediate ends defining a pair of separable shoulder straps forming a V-shaped opening adapted to receive the user's head and with a pouch forming member arranged upon the lower end of the strip and reverse folded and secured thereto and defining with the strip, a pouch to supportably receive a cup containing a softdrink or other beverage.

An important feature is to provide in the strip for the softdrink carrier a pair of laterally spaced upright finger slots adjacent the pouch by which the pouch with a cup of liquid therein may be carried with the user's finger projected through said slots.

An important feature of the present softdrink carrier includes at one end of the strip a pouch forming member which is reverse folded over and in registry with a portion of the strip, with a means for connecting the sides of the pouch forming member and the sides of the strip to define an outwardly openable pouch adapted to receive and support a cup of liquid.

A further feature includes, as a part of the pouch forming member, a pair of laterally directed foldable anchor flaps which may be reverse turned around the strip and suitably secured to the strip. Such securing is selected from the group consisting of an adhesive strip, a heat seal, cementing, dielectric bonding and ultrasonic welding.

Another feature includes depending from the first pouch forming member, a second pouch forming member with both pouch forming members cooperating with adjacent portions of the strip and suitably secured thereto along the corresponding adjacent side edges thereof to provide a reinforced pouch which opens upwardly and outwardly and is adapted to receive a cup of liquid, such as a softdrink or coffee or soup or the like.

Another feature includes as an extension of the strip, a liquid retainer wall connected thereto and adapted for folding over the strip along the interior of the pouch forming member or members and extending thereabove so as to protectively enclose lower portions of the elongated slot within the strip to protect the user against splashing of liquids from the cup and to protect the user from heat or cold.

An important feature is to provide a softdrink carrier adapted also for carrying of cups of hot liquids such as coffee or soup and the like and wherein a pouch forming member forms a part of the strip and is reverse folded thereon and with the strip defines an upwardly opening pouch; and has a liquid retaining wall as an extension of the strip or of the pouch forming member adapted for folding along the height of the strip rearwardly of the pouch forming member as a reinforcement to the strip and to avoid spillage of liquid onto the clothes of the person wearing the holder through the V-shaped opening defined between the straps and prevent the transmission of heat or cold from the container to the user.

These and other features and objects will be seen from the following specification and claims in conjunction with the appending drawings.

THE DRAWINGS

FIG. 1 is a front view of the present softdrink carrier as worn around the neck and shoulders of the user.

FIG. 2 is a front elevational view of one form of the present softdrink carrier in a non use position and on an increased scale relative to FIG. 1.

FIG. 3 is a vertical section taken in the direction of arrow 3—3 of FIG. 2.

FIG. 4 is a fragmentary front elevational view of the lower portion of the strip defining a softdrink carrier in unfolded condition and on a reduced scale relative to FIG. 2.

FIG. 5 is a fragmentary perspective view of the strip shown in FIG. 4 partly folded.

FIG. 6 is a similar view with the respective pouch forming members and liquid retaining wall further folded.

FIG. 7 is a fragmentary front elevational view of the completely assembled pouch with the corresponding pouch forming members overlying the connected liquid retaining wall and secured to the strip.

Figure 8:
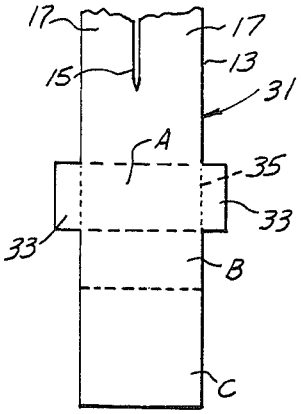
FIG. 8 is a fragmentary front elevational view of a modified softdrink carrier unfolded.
Figure 9:
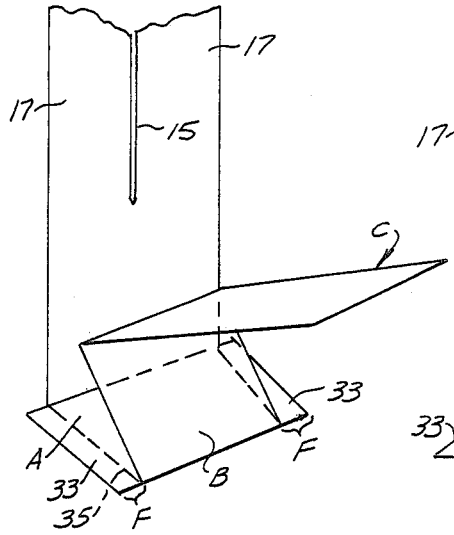
FIG. 9 is a similar view on an increased scale partly folded.
Figure 10:
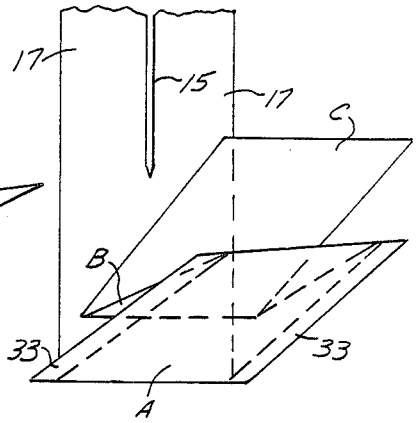
FIG. 10 is a similar view further partly folded.

It will be understood that the above drawings illustrate merely preferred embodiments of the invention, and that other embodiments are contemplated within the scope of the claims hereinafter set forth.

DETAILED DESCRIPTION OF AN EMBODIMENT OF THE INVENTION

Referring to the drawings, the present softdrink carrier 11 shown in a non use position in FIG. 2, is adapted to be worn around and depend from the neck and shoulders of a user as shown in FIG. 1. The softdrink carrier which is equally adaptable for hot liquids such as coffee or soup, includes a depending pouch 29 adapted to support and mount a cup of liquid. Referring to FIGS. 2 and 3, one form of the present softdrink carrier is shown in 11 includes an elongated strip 13 constructed of paper or a plastic material, which is adapted for a single use as a throw-away if desired.

Figure 15:
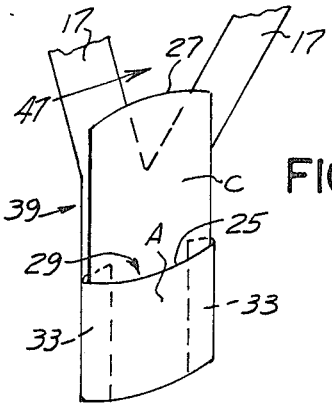
FIG. 15 is a fragmentary view of the strip illustrating the shoulder portions fragmentarily and the depending pouch in a use position.

Strip 13 includes a central longitudinal slot 15 intermediate its ends, defining a pair of separable shoulder straps 17 adapted to form a V-shaped opening 47, FIGS. 1 and 15. A pair of laterally spaced upright finger slots 18 are arranged upon opposite sides of central slot 15 adjacent its lower end. These provide a means of carrying by a finger the present carrier with a cup of liquid loaded within pouch 29. This may be employed for transporting the cup of liquid, hot or cold, from the point of purchase to the point of use such as a seat of a movie theatre.

The softdrink carrier 11 of FIG. 2 is shown in further detail in FIGS. 4–7 wherein strip 13, fragmentarily shown, has the central elongated slot 15. Towards the lower portion of said strip below slot 15, are the spaced transverse fold lines 19, 20 and 21 defining pouch forming members A and B and liquid retaining wall C.

In FIG. 5 pouch forming member A has been folded 90° with respect to strip 13. Pouch forming member B has been folded to an intermediate inclined position, and liquid retaining wall C horizontal. A succession of folding is further illustrated in FIG. 6. The pouch forming members A and B are more closely together and the liquid retaining wall has now been folded towards strip 13, and in registry therewith in FIG. 7.

With the liquid retaining wall C bearing against strip 13, said liquid retaining wall extends along strip 13 and protectively over the lower portion of slot 15. This provides a reinforcement for the strip 13 and the inner-wall which defines pouch 29. Said pouch includes adjacent portions of strip 13, the liquid retaining wall C, and the pair of super-imposed pouch forming members A and B which are in engagement. Their side edges register with corresponding edge portions of liquid retaining wall C and strip 13.

In the embodiment shown in FIG. 7 the corresponding edges of pouch forming members A and B and liquid retaining wall C are secured to corresponding edges of strip 13 by elongated strips of adhesive 23. This defines when formed to an open position the double walled pouch 29 adapted to receive a paper cup, in FIG. 1. Members A and B are flexed outwardly at 25 and wall C is flexed inwardly at 27.

While adhesive strips 23 may be employed, any other suitable means of securing the edges together to complete the pouch may be employed as for example heat sealing, an adhesive dielectric bonding or ultrasonic welding. There is arranged at the lower end of strip 13 the double walled pouch 29 adapted to receive a paper cup, FIG. 1, which can contain a cold liquid such as a softdrink or soup or coffee or other heated beverage.

The liquid retaining wall C performs the function of protecting the wearers clothes against splashing of the liquid through the adjacent lower portion of slot 15. Wall C also prevents the passage of heat or cold through strip 13 to the wearer of the softdrink carrier.

A modified softdrink carrier, a carrier adapted to carry cups of heated liquid being regarded at equivalent, is further illustrated at 31 FIGS. 8–11, being fragmentary illustrations of strip 13, and its central elongated slot 15 and wherein lower portions of strip 13 terminate in the corresponding members A, B and C as described with respect to FIG. 4. Additionally the outer pouch forming member A is formed with laterally extending anchor flaps 33 arranged along fold lines 35. In the final assembled position, FIG. 11 the respective anchor flaps 33 are folded rearwardly as shown by arrow 37 along the fold lines 35 so as to engage adjacent edge portions of strip 13 and is suitably secured thereto by adhesive 23. It is regarded as equivalent that there could be a heat seal or cement or some other form of bonding such as dielectric bonding or ultrasonic welding. The complete assembly provides a double walled pouch 29.

Figure 11:
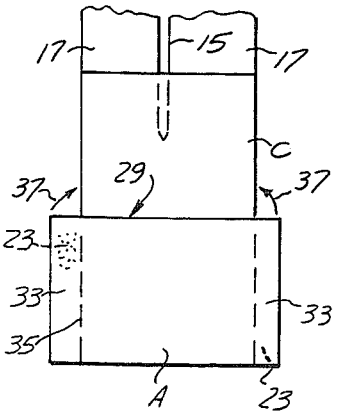
FIG. 11 is a similar view with the parts fully folded except for the fastener flaps.

The improvement over FIG. 7 is that in FIG. 11, the outer pouch forming member A, terminates in the foldable anchor flaps 33 as the means by which the corresponding pouch forming members A and B and the adjacent liquid retaining wall C at their edges are secured to corresponding edges of strip 13.

A modified softdrink carrier 39 is fragmentarily shown in FIGS. 12–15 wherein there is employed only the pouch forming member A and wherein the liquid retaining wall C is formed as a lateral extension of strip 13 along fold line 41. In forming the completed article the liquid retaining wall C is folded over strip 13 along fold line 41 so as to protectively cover the lower portion of slot 15, FIG. 14 and FIG. 15. To provide additional flexibility of the upper end portion of liquid retaining wall C there is provided a slit portion 43 at the upper side portion of retaining wall C adjacent strip 13. This provides for flexibility of the corresponding straps 17 when they are opened up to receive the user's head for the use position FIG. 15.

Corresponding pouch forming member A includes upon its opposite sides a pair of laterally extending anchor flaps 33 along fold lines 35. The assembly is completed FIGS. 12–15 by first folding the liquid retaining wall C to the position shown in FIG. 14 and thereafter folding the anchor flaps 33 to the position shown in FIGS. 14 and 15 and securing them to rear surface portions of the corresponding strip 13. Any of the securing described may be used such as adhesive or bonding.

Figure 12:
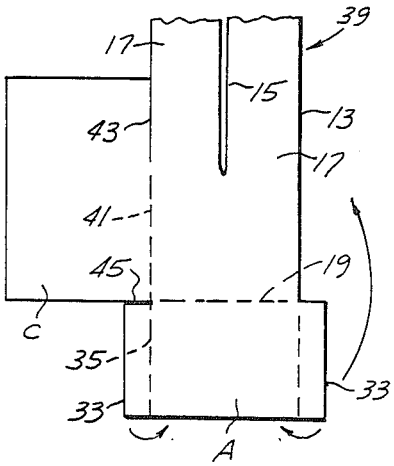
FIG. 12 is a fragmentary elevational view of a modified softdrink carrier unfolded.
Figure 13:
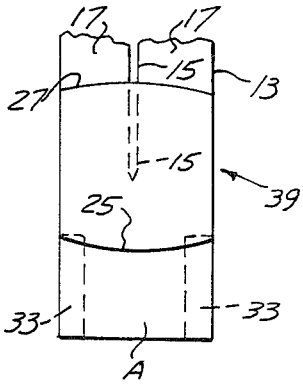
FIG. 13 is a front elevational view of the strip with the pouch forming member and liquid retaining wall folded.
Figure 14:
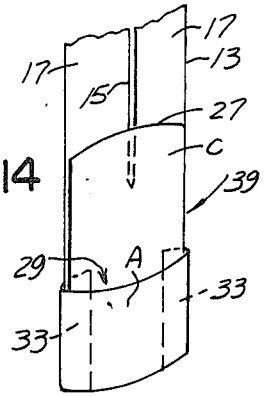
FIG. 14 is similar to FIG. 13 with the pouch forming member and liquid retaining wall formed to define pouch to receive a cup of liquid.

In order to facilitate the use of liquid retaining wall C in its folded position, there is provided an additional slit 45 between one anchor flap 33 and the adjacent liquid retaining wall C, FIG. 12. The corresponding anchor flap can fold freely to the use position shown in FIGS. 14 and 15.

While primarily the present softdrink carrier was initially designed for carrying softdrinks within a cup, FIG. 1, it is regarded as equivalent for the usage of the present invention that the carrier could just as easily be employed for carrying heated drinks such as soup, coffee or tea or the like.

Having described my invention, reference should now be had to the following claims.

I claim:

1. A softdrink carrier comprising an elongated flexible strip having upper and lower ends, opposed sides and a central normally closed longitudinal slot intermediate its ends defining a pair of separable shoulder straps forming a closed loop which surrounds the neck of the wearer to enable the carrier to be worn and supported;

a first pouch-forming member at one end of the strip having spaced sides reverse-folded over and with its sides along their height in engaging registry with the sides of said strip;

and bonding means connecting the sides of said first pouch-forming member to the corresponding engaging sides of said strip, defining a flat pouch which opens forwardly into an upwardly opening generally circular pouch when a cup of liquid is inserted therein conforming to the cup shape to snugly and supportably receive said cup.

2. In the softdrink carrier of claim 1, said strip being formed of a material selected from the group consisting of paper and plastic, and being disposable.

3. In the softdrink carrier of claim 1, said bonding means including a pair of upright lateral flaps upon said first pouch-forming member, reverse-folded over the sides of said strip and secured to said sides.

4. In the softdrink carrier of claim 1, a second pouch-forming member having spaced sides and at one end of said first pouch-forming member reverse-folded over and in registry with said first pouch-forming member and in registry with said strip;

said bonding means further connecting the sides of said second pouch-forming member to said strip.

5. In the softdrink carrier of claim 4, a liquid retaining wall connected to said second pouch-forming member and extending along and above said pouch-forming members covering lower portions of said strip and said longitudinal slot.

6. In the softdrink carrier of claim 5, said bonding means including a pair of upright lateral flaps upon said first pouch-forming member, reverse-folded over the sides of said second pouch-forming member and over the sides of said strip and secured to said sides.

7. A softdrink carrier comprising an elongated strip having upper and lower ends, opposed sides and a central longitudinal slot intermediate its ends defining a pair of separable shoulder straps forming a closed loop which surrounds the neck of the wearer to enable the carrier to be worn and supported;

a pouch-forming member at one end of said strip having spaced sides, reverse-folded over and in registry with the sides of said strip;

means connecting the sides of said pouch-forming member to the corresponding sides of said strip, defining a flat pouch which opens forwardly into an upwardly opening pouch when a cup of liquid is inserted therein conforming to the cup shape to snugly receive said cup; and a liquid retainer wall at one edge connected to and folded over one edge of said strip and extending along and above said pouch forming member protectively covering lower portions of said strip and longitudinal slot.

* * * * *